US007676894B2

(12) United States Patent
Böhm et al.

(10) Patent No.: US 7,676,894 B2
(45) Date of Patent: Mar. 16, 2010

(54) CLASP FOR JEWELRY, ESPECIALLY FOR NECKLACES AND BRACELETS

(76) Inventors: Wolfgang Böhm, Groβer Lückenweg 59, Pforzheim (DE) D-75175; Rolf Bürkle, Wildpfad 15, Pforzheim (DE) D-75180

( * ) Notice: Subject to any disclaimer, the term of this patent is extended or adjusted under 35 U.S.C. 154(b) by 0 days.

(21) Appl. No.: 11/824,653

(22) Filed: Jul. 2, 2007

(65) Prior Publication Data

US 2008/0016657 A1 Jan. 24, 2008

(51) Int. Cl.
*A44B 11/25* (2006.01)

(52) U.S. Cl. ..... 24/612; 24/653

(58) Field of Classification Search ..... 24/110, 24/604, 606, 607, 609–613, 634, 635, 653
See application file for complete search history.

(56) References Cited

U.S. PATENT DOCUMENTS

| | | | | |
|---|---|---|---|---|
| 1,091,449 | A * | 3/1914 | Westin | 280/449 |
| 1,232,733 | A | 7/1917 | Swedlund | |
| 2,594,609 | A | 4/1952 | Cosneck | |
| 3,424,403 | A * | 1/1969 | Hull | 244/173.3 |

FOREIGN PATENT DOCUMENTS

| | | | |
|---|---|---|---|
| CH | 242902 | A | 11/1946 |
| DE | 246399 | C | 9/1911 |
| DE | 2113663 | A | 10/1972 |
| DE | 4232688 | A1 | 3/1994 |
| DE | 20318536 | U1 | 3/2004 |
| GB | 2170260 | A | 12/1994 |

* cited by examiner

*Primary Examiner*—James R Brittain

(57) ABSTRACT

The invention describes a clasp for jewelry, especially for necklaces and bracelets, comprising a push-in fastener element, a receptacle element for receiving the push-in fastener element, a latching mechanism by means of which the push-in fastener element can be latched in the receptacle element, the latching mechanism comprising a spreadable latching means which when spread comes into a form-locking engagement with the receptacle element, and a handling means that can be gripped from outside of the receptacle element, for operation of the latching mechanism.

Figure 1:
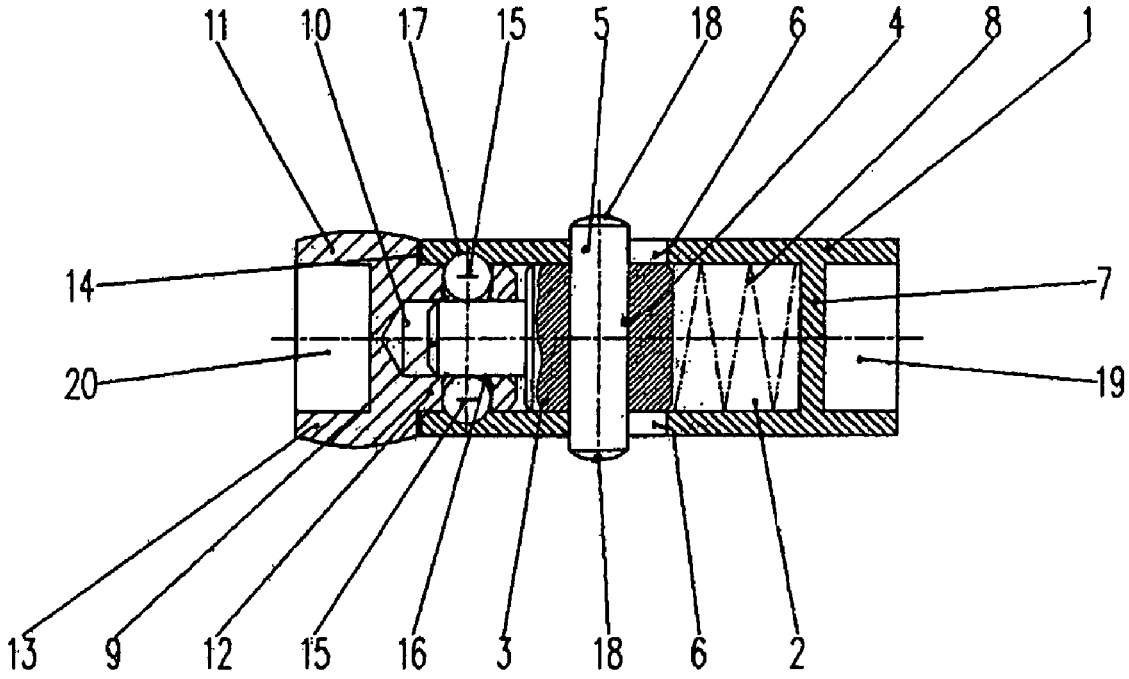

It is provided according to the invention that the handling means is attached to a slide which is provided in the receptacle element and which in a first position, hereafter described as the latched position, is in engagement with the latching means and holds the latter in spread condition while in a second position, hereafter described as the unlatched position, it does not hold the latching means in spread condition.

19 Claims, 1 Drawing Sheet

CLASP FOR JEWELRY, ESPECIALLY FOR NECKLACES AND BRACELETS

The present invention relates to a clasp for jewelry, especially for necklaces and bracelets, comprising a push-in fastener element, a receptacle element for receiving the push-in fastener element, a latching mechanism by means of which the push-in fastener element can be latched in the receptacle element, the latching mechanism comprising a spreadable latching means which when spread comes into a form-locking engagement with the receptacle element, and a handling means that can be gripped from outside of the receptacle element, for operation of the latching mechanism A clasp frequently used for necklaces comprises a V-shaped resilient push-in fastener element that can be introduced, in compressed condition, into a receptacle element and can be locked in the latter due to the fact that it will spring back a little to enter into form-locking engagement with the receptacle element. During that movement, a setback in one of the legs of the push-in fastener element springs against an edge of the receptacle element. A section of the V-shaped push-in fastener element, which is provided, for example, with an eye for attachment of a necklace thread or a chain, remains outside the receptacle element in the latched position for use as a handle for operation of the latching mechanism. Although the known clasp needs a relatively big receptacle element it is still not easy to handle, especially when it has to be manipulated blind. There is also the possibility that the clasp may be opened inadvertently or that the locking forces may be insufficient to counteract the effects of tensile stresses encountered, in which case it all depends on whether the clasp has a reliable arrester mechanism.

There have further been known clasps for necklaces that comprise a spherical receptacle body with an integrated latching mechanism. The spherical body is equipped with an eye for attachment to the necklace. An opening provided opposite the eye serves to introduce a bayonet key into the interior latching mechanism which can then be latched by a combined pushing and turning movement. Such clasps are expensive to produce, difficult to handle due to the small size of the key, and are not secure against inadvertent unlocking.

Now, it is the object of the present invention to provide a clasp for jewelry, especially for necklaces and bracelets, which can be easily handled even blind without having to search for a latching position or having to use one's finger nails, which can be produced even in small dimensions and which nevertheless is robust and provides a high degree of safety against inadvertent unlocking.

The clasp according to the invention comprises a push-in fastener element, a receptacle element for receiving the push-in fastener element, and a latching mechanism by means of which the push-in fastener element can be latched in the receptacle element. The latching mechanism comprises a spreadable latching means which when spread comes into a form-locking engagement with the receptacle element. A handling means for operation of the latching mechanism can be gripped from the outside of the receptacle element. The handling means is attached to a slide which is provided in the receptacle element and which in a latched position is in engagement with the latching means and holds the latter in a spread position while it does not hold the latching means in the spread condition in an unlatched condition.

This arrangement provides substantial advantages:

As long as the slide occupies its latched position, the push-in fastener element and the receptacle element cannot be separated because this would require that a stable form-fit be destroyed.

Once the slide is moved to its unlatched position, the push-in fastener element and the receptacle element can be readily separated one from the other.

The handling means, being configured as an element separate from the push-in fastener element, can be felt blind without any problem, especially in cases where it can be felt from the outside of the receptacle element, being comparatively big in that case.

The pushing movement necessary for latching and unlatching can be performed easily and even without looking.

Pulling forces acting on the necklace do not attempt to transfer the slide from its latched position to its unlatched position. Pull exerted on the necklace—small children carried in a person's arms like to do that—does not present a risk that the necklace may be opened.

A slide is easy to secure in a predefined position. Securing the slide in the unlatched position is superfluous.

Advantageous further developments of the invention are the subject-matter of the sub-claims.

The slide may be secured, for example, by providing that an action point has to be overcome for transferring the slide from its latched position to its unlatched position. Preferably, the slide is retained in its latched position by a spring. The latter may be a leaf spring, on which the slide rides and which exerts a force on the slide that is directed transversely to its direction of movement, the force having a maximum between the latched position and the unlatched position. However, an especially favorable and at the same time simple solution is obtained when a spring is provided that gets tensioned when the slide is displaced from its latched position to its unlatched position so that the restoring force of the spring, once released, will always return the slide to its latched position. This is achieved most simply by a helical spring that acts on the end of the slide opposite the latched position, in the direction of movement. This embodiment is especially favorable not only in terms of function but also in terms of production.

Conveniently, the slide is provided with an extension that engages the latching means in the latched position, especially a spike which is pushed into the latching means so as to spread the latter for latching the clasp. Spreading occurs transversely to the direction of displacement, which is especially favorable as it ensures that any tensile forces will act in the necklace transversely to the spreading direction and will not tend to reverse the spreading.

Depending on the particular configuration of those elements of the latching means that are spread it may be of advantage if the extension of the slide, which provokes the spreading action when being introduced into the latching means, is provided with an entry chamfer, an entry cone or with a bevel on its tip. However, in the latched position, the spread elements of the latching means should conveniently not rest on an inclined surface of the slide the inclination of which has such a direction that a restoring force might be exerted on the slide by the spread elements of the latching means.

According to an advantageous embodiment, the handling means that serves to actuate the slide may be a pin that is passed transversely through the slide and that projects through two oppositely arranged oblong holes in an outer wall of the receptacle element so that the ends of the pin can be gripped between two fingers and can be displaced in the oblong holes which conveniently have their longitudinal direction extending in parallel to the direction of displacement of the slide.

Preferably, the ends of the pin extend in a cover element that covers the respective oblong hole in the outer wall of the receptacle element. This provides a double advantage: On the one hand, it increases the size of the handling means thereby facilitating operation of the slide. On the other hand, it provides a cover for the oblong hole whereby the appearance of the clasp is enhanced. The configuration of the cover element may be selected so that in addition to being easily felt it will also decorate the clasp.

According to a preferred further development of the clasp, the cover element is a sleeve which is arranged on the receptacle element for sliding displacement. One thereby obtains a working surface of maximum size for the handling means and also optimum guidance for the slide in the longitudinal direction. Such a sleeve is a solution that gives the least impression of a functional technical element and that can be decorated on its outside in the most different ways.

According to another embodiment of the invention, instead of forming the handling means on the slide by a pin passed transversely through the slide, two or more than two rolling elements, especially balls, are provided on the periphery of the slide. Each ball co-acts with an oblong hole in the outer wall of the receptacle element, the ball projecting into the oblong hole and a little beyond the outside of the outer wall of the receptacle element. The portion of the wall that projects beyond the outer wall engages a groove provided on the inside of a sleeve movably seated on the receptacle element. The balls are caught in this way between the slide and the sleeve in a way resembling a ball cage. Preferably, the slide is provided for this purpose with an annular slot or an annular groove that corresponds with the groove in the sleeve on the receptacle element. Two diametrically arranged balls are preferred. Alternatively, three balls may likewise be provided. More than three balls would increase the cost without providing any particular additional benefit. It is one advantage of that embodiment that the ball bearing will make movement of the slide extraordinarily smooth. That smooth movement will be maintained for a long period of time even though the clasp may in part consist of relatively soft precious metal materials. In addition, the clasp is capable of rotating in itself so that any unwanted torsion that may occur when closing the necklace can be balanced out.

Different configurations can be selected for the elements of the latching means that are spread during the closing operation. For example, the elements may consist of the two legs of a U-shaped spring clip that get spread during introduction of the slide. Or they may consist of two short rods, fitted in diagonally arranged bores in the push-in fastener element, that can be driven apart radically by introduction of the slide or an extension of the slide. An especially preferred embodiment of the invention is one where the push-in fastener element has a section which engages the receptacle element and in which two or more than two rolling elements or rolling bodies, especially balls—hereafter called the second rolling elements—are distributed over the periphery of the push-in fastener element and are caught in the push-in fastener element in such a way that in a first position—hereafter called their latched position—they will project beyond the outer surface of the section of the push-in fastener element engaging the receptacle element and engage a matching recess provided in the receptacle element. However, in a second position—hereafter called the unlatched position—the rolling elements, especially the balls, do not engage the corresponding recess in the receptacle element but do not project beyond the outside of the section of the push-in fastener element that engages the receptacle element. The push-in fastener element has to be provided with a hole, especially a bore, extending in the sliding direction of the slide, which can be engaged by the forward section of the slide so as to permit the slide to act on the balls. In order for this to be possible the balls must project into the hole of the push-in fastener element in their unlatched position by at least the same. amount by which they are to project outwardly from the push-in fastener element in the latched position. Accordingly, the peripheral wall of the push-in fastener element has a thickness smaller than the diameter of the balls. The ball may be caught simply by providing the push-in fastener element with radically extending bores of a diameter slightly larger than the diameter of the ball. Once the ball has been placed in such a bore, the edges of the latter are deformed inwardly, for example by caulking, so that the diameter of the two openings of each bore is made smaller than the diameter of the ball received in that bore.

Experience has shown that the balls can be caught reliably in this way.

That embodiment of the clasp distinguishes itself not only by its very reliable latched condition, which withstands even high tensile forces, but also by an especially smooth latching movement.

It has proven to be a good solution if the wall thickness of the push-in fastener element and the diameter of the walls are adjusted one to the other so that in the latched position the balls will project beyond the outer surface of the section of the push-in fastener element that engages the receptacle element by 10% to 30% of their diameter.

The recess in the receptacle element, which is engaged by the bores in their latching position, preferably consists of an annular groove, formed in the inner peripheral surface of the receptacle element, the contour of which conveniently is given the shape of a circular arc having a curvature somewhat smaller than that of the balls so that the balls will easily slide into the groove and roll out of it again.

The geometry of the slide, its extension and at least that section of the push-in fastener element that is received in the receptacle element preferably is that of a cylinder, being the geometry most convenient with respect to both production and handling.

Certain embodiments of the invention are illustrated in the attached drawings in which identical or corresponding parts are indicated by identical reference numerals.

Figure 2:
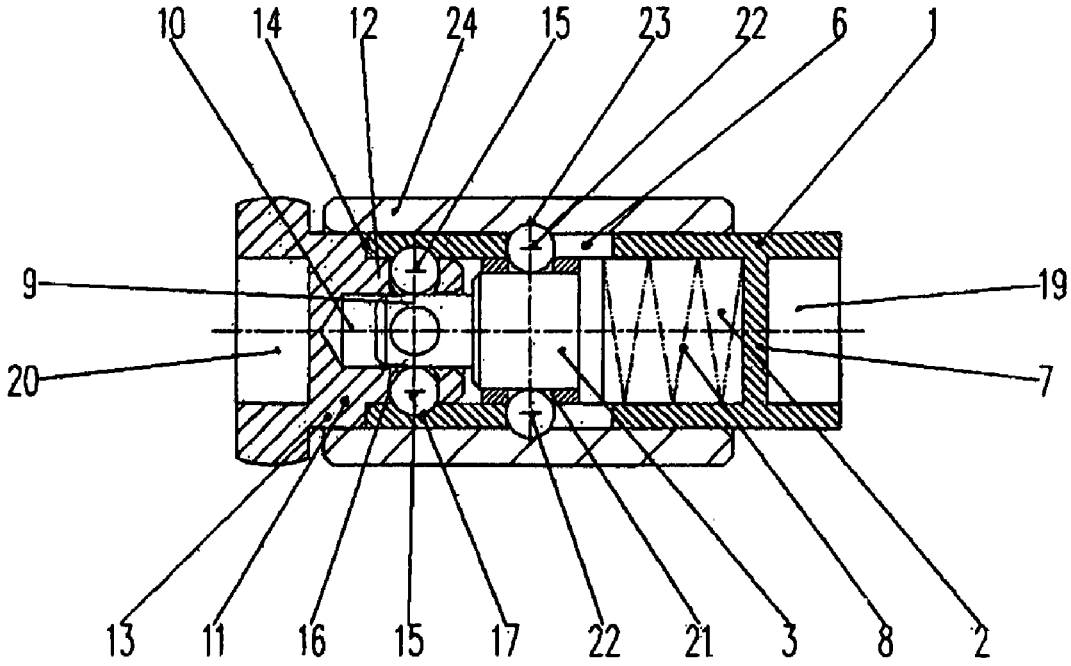

FIG. 1 shows a longitudinal section of a first embodiment of the clasp according to the invention; and FIG. 2 shows a longitudinal section of a second embodiment of the clasp according to the invention.

The clasp illustrated in FIG. 1 comprises a cylindrical receptacle element 1 with a blind bore 2 extending over the largest part of its length, in which a slide 3 is arranged for displacement in lengthwise direction. The outer diameter of the slide 3 is closely adapted to the inner diameter of the bore 2 so that the slide 3 is efficiently guided during displacement. The slide 3 has a transverse bore 4 in which a cylindrical pin 5 is fitted that has a length greater than the outer diameter of the receptacle element 1. The pin 5 is held in the slide 3 undetachably, for example by being pressed into the bore 4. Two diametrically opposite oblong holes 6 are provided in the cylindrical wall of the receptacle element, with the ends of the pins 5 projecting through such holes. The length of the oblong holes 6 that exceeds the diameter of the pins 5 defines the distance the slide 2 can be displaced in forward and backward direction. The wall 7, which defines the end of the blind hole 2, and the slide 3 hold between them a helical spring 8 that urges the slide 3 into its latched position illustrated in FIG. 1.

On its side opposite the helical spring 8 the slide 3 is provided with an extension 9 in the form of a cylindrical spike that is rounded or provided with a chamfer on its forward edge. The extension 9 engages a matching cylindrical bore 10 in a push-in fastener element 11 which latter has a cylindrical section 12 the diameter of which corresponds to the outer diameter of the slide 3. The section 12 is followed by a section 13 of the push-in fastener element, the outer diameter of which preferably corresponds to the outer diameter of the receptacle element 1. Alternatively, the section 13 may have e. g. a contour like a barrel, as shown in FIG. 1, having the advantage that its shape can be easily detected by feeling with fingers. A shoulder 14 formed at the transition between the two sections 12 and 13 defines the point up to which the push-in fastener element 11 can be introduced maximally.

The section 12 of the push-in fastener element 11 has two diagonally arranged bores with a ball 15 caught in each of the bores, the diameter of the balls being smaller than the diameter of the bores 16 by an amount just suited to ensure that the ball is still allowed to move in the bore 16. The outer edges of the bores 16 are deformed inwardly so that the balls 15 are caught in the bores 16 undetachably. The diameter of the balls 15 is so adapted to the wall thickness of the section 12 of the push-in fastener element 11 that the balls 15 will necessarily project beyond the inner surface, which may be the case in the unlatched position, or beyond the outer surface of the section 12, which will be the case in the latched position.

For closing the clasp, the section 12 of the push-in fastener element 11 is introduced into the bore 2 of the receptacle element 1. During this movement, the balls 15 are initially forced into a position in which they project inwardly beyond the inner surface of the section 12. They thus hit upon the extension 9, pushing it back against the force of the spring 8 until the balls, in their latched position illustrated in FIG. 1, are urged by the extension 9 into a groove 17 provided in the peripheral wall of the bore 2. The balls 15, having been displaced into the groove 17, thereby clear the way and permit the extension 9 to move between the two balls 15, whereby the slide 3 is pushed by the spring 8 from its unlatched position, in which the pin 5 is located approximately at the right edge of the oblong hole 4, to its latched position illustrated in FIG. 1. In that position, the balls 15 in the groove 17 are blocked which means that the push-in fastener element 11 cannot be withdrawn from the receptacle element: The clasp is latched. For unlatching the clasp, one grips the rounded caps 18 provided on the ends of the pin 5 between one's thumb and index finger and pulls the pin 5 to the right end of the oblong hole 6, against the force of the spring 8. The balls 15 are no longer blocked in that unlatched position, the push-in fastener element 11 can be easily pulled off the receptacle element 1. Recesses 19 and 20 on the mutually opposite ends of the receptacle element 1 and the push-in fastener element 20 serve for attaching the ends of a necklace or a bracelet, for example a chain link, by soldering.

The embodiment illustrated in FIG. 2 differs from that shown in FIG. 1 in that the slide 3, instead of having a continuous pin 5, is provided with an annular groove 21 for receiving two balls 22 that project to the outside through the corresponding oblong hole 6 and engage a groove 23 provided on the inside of a sleeve 24 which latter encloses the push-in fastener element 11 and the receptacle element 1 over part of their lengths, being guided thereon in sliding relationship. When the sleeve 24 is displaced, it entrains the balls 22 until they come to abut against the right-hand edge of the oblong holes 6. The balls entrain the slide against the force of the spring 8. Accordingly, the clasp is unlatched in a way corresponding perfectly to that illustrated for the clasp according to FIG. 1. For latching the clasp, one proceeds exactly in the same way as described for the example in FIG. 1, in that one grips the receptacle element between the fingers of one hand and the push-in fastener element 11 between the fingers of one's other hand and simply pushes them together until the balls 15 of the push-in fastener element snap into place audibly and the slide 3 springs into its latched position.

List of Reference Numerals:

1. Receptacle element
2. Bore
3. Slide
4. Bore
5. Pin
6. Oblong holes
7. Wall
8. Helical spring
9. Extension
10. Bore
11. Push-in fastener element
12. Section
13. Section
14. Shoulder
15. Ball
16. Bore
17. Groove
18. Cap
19. Recess
20. Recess
21. Annular groove
22. Ball
23. Groove
24. Sleeve

The invention claimed is:

1. Clasp for jewelry, comprising a push-in fastener element, a receptacle element for receiving the push-in fastener element, a latching mechanism by means of which the push-in fastener element can be latched in the receptacle element, the latching mechanism comprising a spreadable latching means which when spread comes into a form-locking engagement with the receptacle element, and a handling means that can be gripped from outside of the receptacle element, for operation of the latching mechanism, in which the handling means is attached to a slide which is provided in the receptacle element and which in a first position, hereafter described as the latched position, is in engagement with the latching means and holds the latter in spread condition while in a second position, hereafter described as the unlatched position, it does not hold the latching means in spread condition, wherein the push-in fastener element has a section engaging the receptacle element, in which section two or more than two rolling elements are distributed over the periphery of the push-in fastener element and are caught in such a way that in a first position, hereafter called their latched position, they will project beyond the outer surface of the engaging section of the push-in fastener element and engage a matching recess provided in the receptacle element and that in a second position, hereafter called the unlatched position, the rolling elements do not engage the matching recess in the receptacle element.

2. The clasp as defined in claim 1, in which the slide is retained in its latched position by a spring.

3. The clasp as defined in claim 2, in which the handling means is a pin that is passed transversely through the slide and that projects through two oppositely arranged oblong holes in an outer wall of the receptacle element.

4. The clasp as defined in claim 2, in which the spring is tensioned when the slide is displaced from its latched position to its unlatched position.

5. The clasp as defined in claim 4, in which the handling means is a pin that is passed transversely through the slide and that projects through two oppositely arranged oblong holes in an outer wall of the receptacle element.

6. The clasp as defined in claim 1, in which the slide is provided with an extension that engages the latching means in the latched position.

7. The clasp as defined in claim 6, in which the handling means is a pin that is passed transversely through the slide and that projects through two oppositely arranged oblong holes in an outer wall of the receptacle element.

8. The clasp as defined in claim 6, in which the extension is a spike.

9. The clasp as defined in claim 8, in which the handling means is a pin that is passed transversely through the slide and that projects through two oppositely arranged oblong holes in an outer wall of the receptacle element.

10. The clasp as defined in claim 1, in which the handling means is a pin that is passed transversely through the slide and that projects through two oppositely arranged oblong holes in an outer wall of the receptacle element.

11. The clasp as defined in claim 10, in which the ends of the pin extend in a cover element that covers the respective oblong hole in the outer wall of the receptacle element.

12. The clasp as defined in claim 11, in which the cover element is a sleeve surrounding the receptacle element and arranged for sliding displacement on the receptacle element.

13. The clasp as defined in claim 1, wherein further rolling elements are provided on the periphery of the slide, project each into an oblong hole provided in an outer wall of the receptacle element and associated to a respective one of the further rolling elements which engage a groove provided on the inside of a sleeve that is slidably seated on the receptacle element.

14. The claps as defined in claim 13, in which the further rolling elements are balls.

15. The clasp as defined in claim 1, in which the rolling elements are balls.

16. The clasp as defined in claim 1, in which the rolling elements project in their latched position beyond the outer surface of the engaging section of the push-in fastener element by not more than 30% of their diameter.

17. The clasp as defined in claim 1, in which the recess in the receptacle element is a groove.

18. The clasp as defined in claim 1, in which the contour of the recess , viewed in a longitudinal cross-section through the receptacle element, has a shape of a circular arc.

19. The clasp as defined in claim 1, in which the geometry of the slide, its extension and at least that section of the push-in fastener element that is received in the receptacle element is that of a cylinder.

* * * * *